US006402538B2

(12) United States Patent
Suzuki

(10) Patent No.: US 6,402,538 B2
(45) Date of Patent: Jun. 11, 2002

(54) CONNECTOR SEALING STRUCTURE

(75) Inventor: Shogo Suzuki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/790,706

(22) Filed: Feb. 23, 2001

(30) Foreign Application Priority Data

Feb. 25, 2000 (JP) ..... 2000-049927

(51) Int. Cl.[7] ..... H01R 13/52
(52) U.S. Cl. ..... 439/271; 439/587
(58) Field of Search ..... 439/271, 272, 439/281, 586, 587, 589

(56) References Cited

U.S. PATENT DOCUMENTS 4,698,027 A * 10/1987 Vandame ..... 439/271
6,247,956 B1 * 6/2001 Porter, Jr. ..... 439/281

FOREIGN PATENT DOCUMENTS

GB 2 175 460 A 11/1986

* cited by examiner

*Primary Examiner*—Tho D. Ta
(74) *Attorney, Agent, or Firm*—Finnegan, Henderson, Farabow, Garrett & Dunner, L.L.P.

(57) ABSTRACT

A connector sealing structure comprises a first connector having one or more first terminals and a second connector having one or more second terminals. Each of the first terminals is accommodated in an associated first chamber of the first connector, and each of the second terminals is accommodated in an associated second chamber of the first connector. The first chamber has a groove on its bottom and around the associated first terminal, and the second chamber has a guide and a sealing member attached to the inner wall of the guide. The sealing member has one or more first sealing projections and one or more second sealing projections. When the second connector is connected to the first connector, the guide of the second chamber is fit into the groove of the first chamber. At the same time, the first sealing projections of the sealing member come into tight contact with the bottom of the first chamber, and the second sealing projections come into tight contact with the first terminal.

21 Claims, 5 Drawing Sheets

CONNECTOR SEALING STRUCTURE

The present patent application claims the benefit of earlier Japanese Patent Application No. 2000-499927 filed Feb. 25, 2000, the disclosure of which is entirely incorporated herein by reference.

BACKGROUND OF THE INVENTION

1. Field of the Invention

The present invention relates to a connector sealing structure for coupling and sealing a female connector and a male connector. More specifically, the invention relates to an improved connector sealing structure that can effectively prevent leaks between the adjacent terminal plugs of the connector, and at the same time, shut out water drops, preventing them from reaching the terminal plugs.

2. Description of the Related Art

In general, high-voltage electric circuits are used in an automobile, and the voltage applied to the circuits has been becoming higher. With such high-voltage electric circuits, leaks are becoming more likely to occur between adjacent terminals of a connector for coupling the circuits. Leaks may cause an automobile to catch fire, and therefore, many proposals have been made to prevent leak in the connector.

FIGS. 1 and 2 illustrate an example of a conventional connector sealing structure for preventing leak. A first connector 103 that has male terminals 102 in the associated chambers (or recesses) 101 is coupled with a second connector 106 that has female terminals 105 in the associated chambers 104. The chambers 104 of the second connector 106 are inserted in the chambers 101 of the first connector 103, and the male terminals 102 are fit into the female terminals 105. A sealing member 107 consisting of elastic and insulating material is furnished along the outer wall of each female terminal chamber 104. The sealing member 107 seals up the counterpart chamber for the associated male terminal independently.

The sealing member 107 has a projection 107*a*, which comes into tight contact with the inner wall 101*a* of the male terminal chamber 101. The projection 107*a* can seal up the associated male terminal chamber 101, and thereby preventing leak between the male terminals 102 of adjacent chambers. The projection 107*a* can also prevent water drops from entering the chamber 101. The sealing member 107 has both a leak-prevention function and a water shutout function.

However, the sealing member 107 of the conventional sealing structure is likely to be scratched or damaged, or otherwise, dusts easily stick to the projection 107. In this case, water drops may get into the terminal chamber and reach the male terminal 102. This can lead to undesirable leaks or short-circuits between the adjacent terminals.

SUMMARY OF THE INVENTION

Therefore, it is an object of the invention to provide an improved sealing structure for a connector that can reliably prevent leakage between adjacent terminals of the connector, and at the same time, shut out water drops from reaching the terminals.

To achieve this object, a connector sealing structure of the present invention includes a first connector, which has one or more first terminals accommodated in the associated first chambers in its housing, and a second connector, which has one or more second terminals accommodated in the associated chambers. As a feature of the invention, each of the first chambers has a groove formed at the bottom of the chamber so as to surround the root of the first terminal, and each of the second chambers has a guide at its end. The second chamber also has a seal on the inner wall of the guide.

This arrangement allows each chamber of the first and second connectors to be sealed up independently in a reliable manner. Consequently, leakage between two adjacent terminals is effectively prevented, and at the same time, water drops are prevented from entering the first terminal chambers.

The seal has one or more first sealing projections and one or more second projections. As the second connector is connected to the first connector, the guide is fit into the groove. At this time, the first sealing projections of the seal come into tight contact with the bottom of the first chamber, and the second sealing projections come into tight contact with the first terminal.

The second sealing projections of the sealing member enhance the effectiveness of the connector sealing structure by sealing up the gap between the first chamber and the first terminal. This arrangement improves the water shutout function of the connector sealing structure.

The leading end of the guide enters the groove of the first chamber ahead of the first sealing projections reaching the bottom of the first chamber. The groove increases the total length from the end of the housing of the first connector to the first terminal. This means that even if water drops get into the gap between the housings of the first and second connectors, a substantial distance is guaranteed before the water drops reach the first terminal. Accordingly, undesirable leakage or short circuit is effectively prevented.

The guide of the second chamber may be formed monolithically with the second chamber, or alternatively, the seal may be formed monolithically with the second chamber.

Preferably, the sealing member is made of an elastic insulator so as to efficiently prevent leakage between terminals, and at the same time, prevent water drops from getting into the chambers.

BRIEF DESCRIPTION OF THE DRAWINGS

Other objects and advantages will be apparent from the following detailed description of the invention in conjunction with the attached drawings, in which.

DETAILED DESCRIPTION OF THE PREFERRED EMBODIMENTS

The preferred embodiment of the connector sealing structure will now be described in detail.

<Overall Structure>

Figure 1:
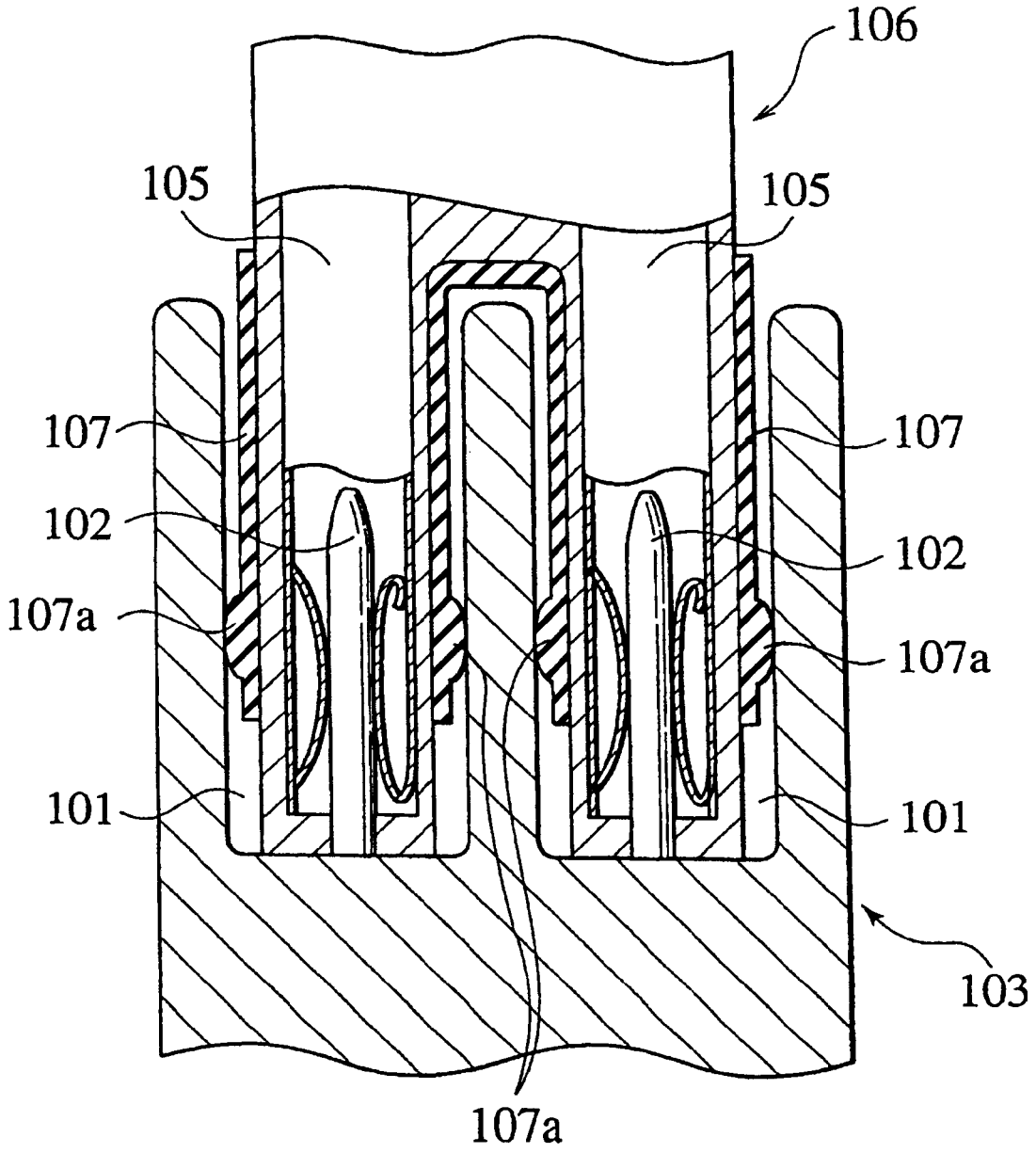
FIG. 1 PRIOR ART
FIG. 1 illustrates a conventional sealing structure for coupling and sealing a male connector and a female connector.
Figure 2:
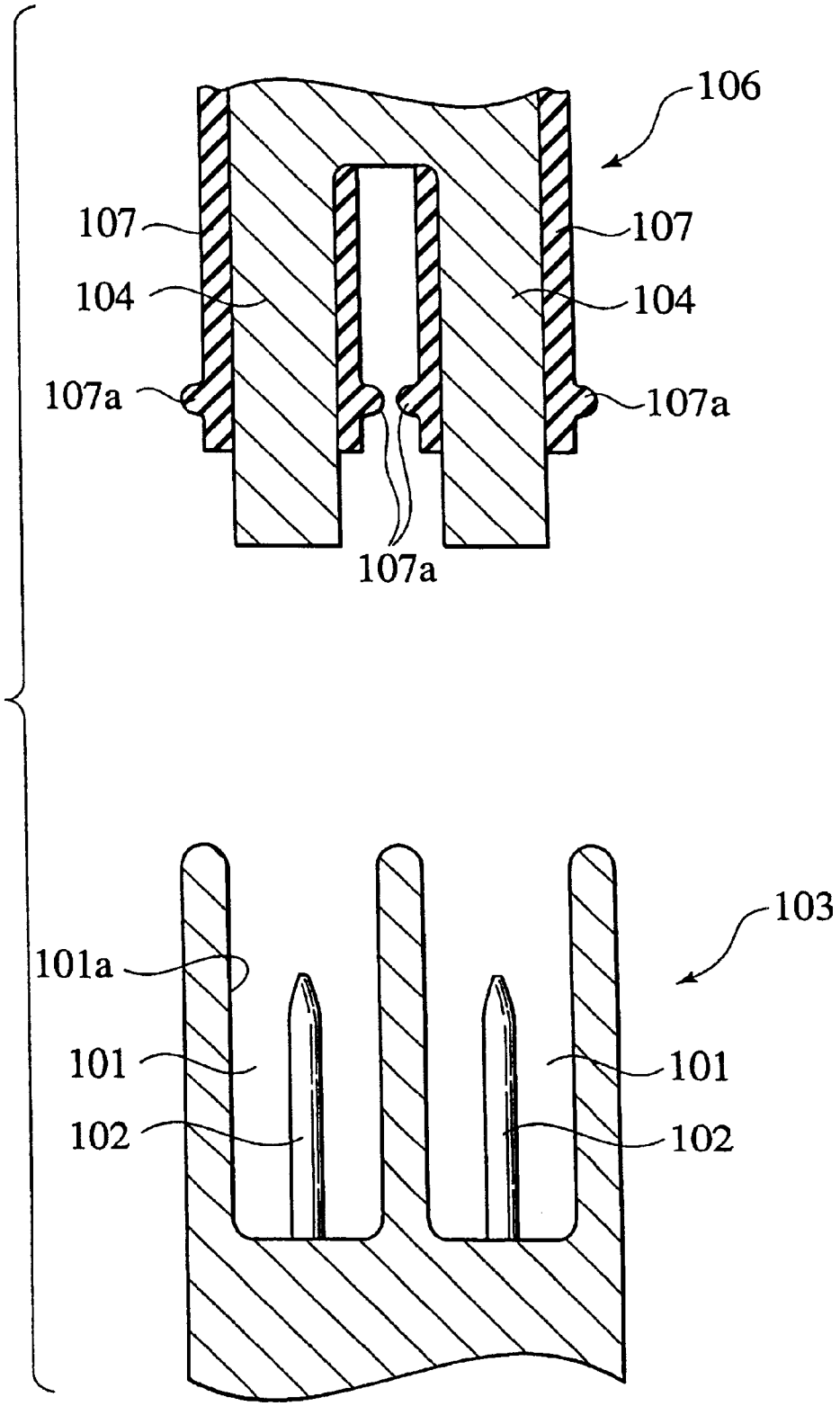
FIG.2 PRIOR ART
FIG. 2 is an exploded view of the sealing structure shown in FIG. 1.
Figure 3:
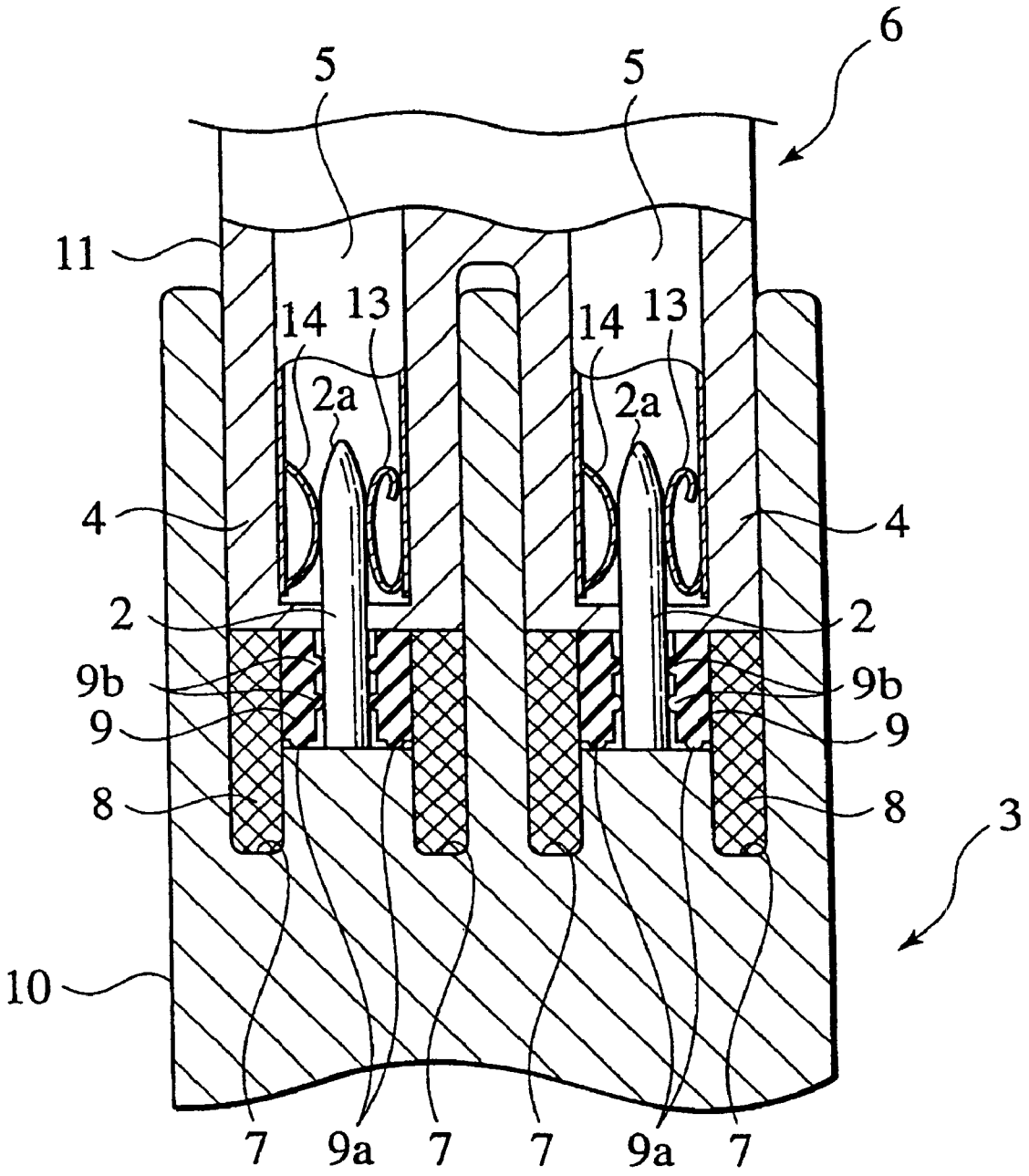
FIG. 3 is a cross-sectional view of the connector sealing structure according to a preferred embodiment of the invention.
Figure 4:
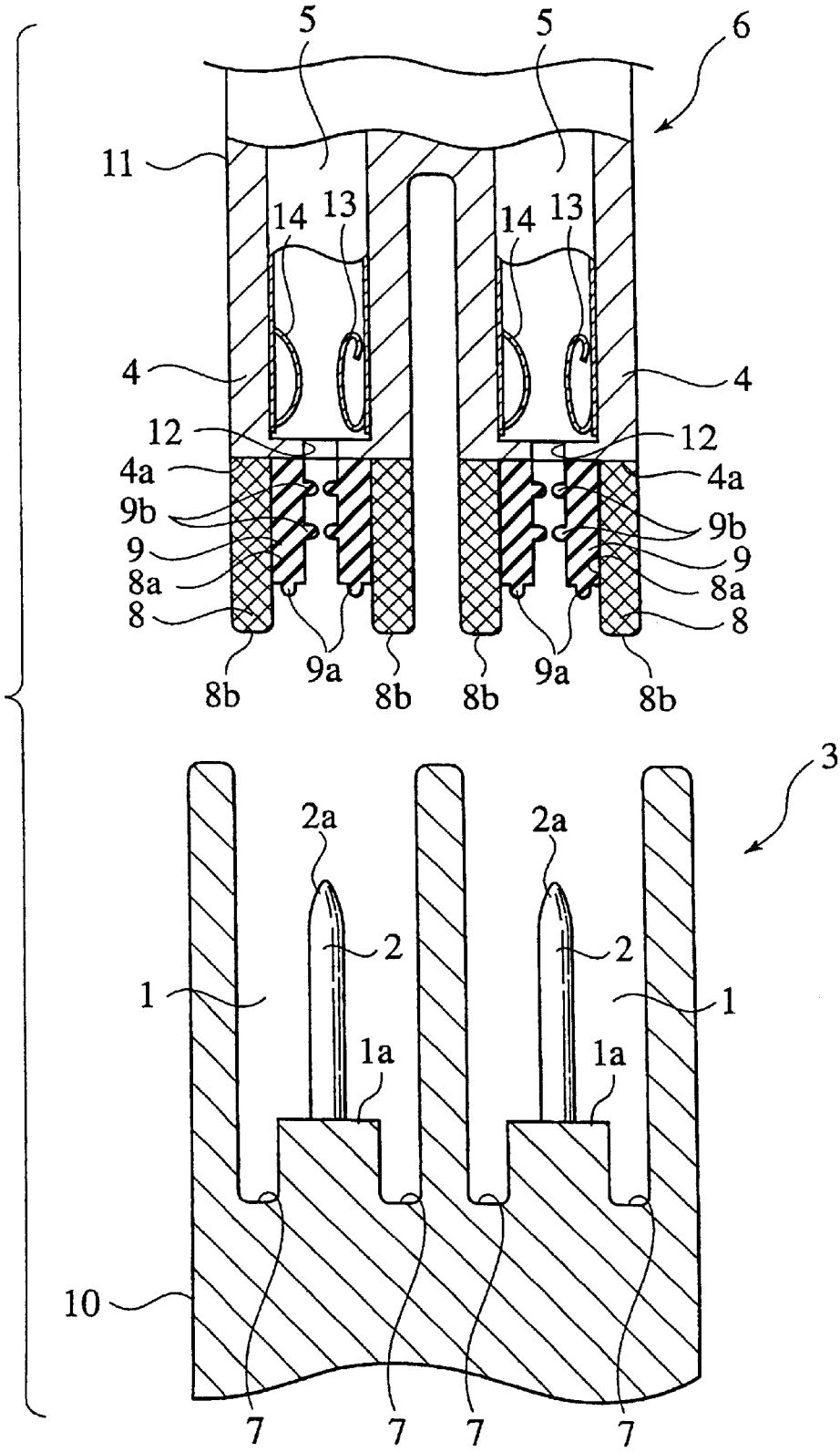
FIG. 4 is an exploded view of the connector sealing structure, which shows the essential portions of the first and second connectors.

The connector sealing structure comprises a first connector 3 and a second connector 6, as shown in FIGS. 3 and 4.

The first connector 3 has one or more terminal plugs 2, each of which is located in the associated chamber 1. The second connector 6 has one or more terminal jacks 5, each of which is located in the associated chamber 4. The terminal plugs 2 come into contact with the terminal jacks 5 when the second connector 6 is connected to the first connector 3.

<First Connector>

The first connector 3 has a connector housing 10, into which the second connector 6 is to be inserted. One or more first chambers 1 are formed in the housing 10 at a predetermined interval. The terminal chambers 1 are independent of each other, and each chamber 1 accommodates a terminal plug (or a male terminal) 2. The terminal plug 2 has a tab or a taper 2*a* facing the opening of the chamber 1.

Each chamber 1 has a groove 7 at the bottom 1*a*, which is formed so as to surround the terminal plug 2. The groove 7 is to receive a guide 8 of the second connector 6, which will be described below. The actual view of the groove 7 can be, for example, circular, rectangular, or any other shape as long as the groove 7 completely surrounds the terminal plug 2.

<Second Connector>

The second connector 6 has a connector housing 11, in which one or more second chambers 4 are formed. The second chambers 4 are independent of each other, and each chamber 4 accommodates a terminal jack (or a female terminal) 5. The terminal jack 5 comes into contact with the terminal plug 2 of the first connector 3. The second terminal chambers 4 are fit into the first terminal chambers 1 when the second connector 6 is connected to the first connector 3. The terminal jack (or the female terminal) 5 has an elastic contact 13 and an elastic receiver 14, which cooperate to hold the tab 2*a* of the terminal plug 2 of the first connector 3 from both sides. The chamber 4 has an opening 12 in its end face, from which the tab 2*a* of the terminal plug 2 is inserted toward the elastic contact 13.

The second chamber 4 has a guide 8 on its end tip. The guide 8 is, for example, either a rounded or squared projection, which is formed monolithically with the second chamber 4 in this embodiment. The guide 8 is fit into the groove 8 of the first chamber 1 when the second connector 6 is connected to the first connector 3. A seal 9 is furnished along the inner face 8*a* of the guide 8. The seal 9 has a leak preventing function and a water shutout function.

The seal 9 is preferably an elastic insulator in order to prevent leakage between two adjacent terminals 2 of the first connector 3. The seal 9 has a first sealing projection 9*a*, which comes into tight contact with the bottom 1*a* of the first chamber 1 of the first connector 3, and second sealing projections 9*b*, which come into tight contact with the terminal plug 2 of the first connector 3.

The first sealing projection 9*a* is, for example, an annular projection provided on the leading end of the seal 9. The vertical cross-section of the first sealing projection 9 is, for example, semicircular. Since the first sealing projection 9*a* is in tight contact with the bottom 1*a* of the first chamber 1, undesirable water drops are shut out and prevented from getting into the first chamber 1. This arrangement is also effective in preventing leaks between adjacent terminal plugs 2.

The second sealing projections 9*b* are formed in the inner face of the seal 9. In the example shown in FIG. 4, two second sealing projections 9*b* are formed at a prescribed distance between them. The second sealing projections 9*b* are also annular projections with semicircular cross-sections to receive the terminal plug 2. The second sealing projections 9*b* come into tight contact with the side face of the terminal plug 2 in order to shut out water drops from getting into the second chamber 4.

The height of the guide 8 and the height of the seal 9 are selected so that the leading end 8*b* of the guide 8 is inserted into the groove 7 before the first sealing projection 9*a* reaches the bottom 1*a* of the first chamber 1.

<Connection of Two Connectors>

When connecting the first connector 3 and the second connector 6, the second chambers 4 of the second connector 3 are inserted into the corresponding first chambers 1 of the first connector 3.

As has been mentioned above, the leading end 8*b* of the guide 8 gets into the groove 7 ahead of the first sealing projection 9*a* reaching the bottom 1*a* of the first chamber 1.

The groove 7 formed in the bottom 1*a* of the first chamber 1 increases the total distance from the top of the first chamber 1 to the root of the terminal plug 2 located at the center of the first chamber 1. This arrangement prevents water drops from reaching the terminal plug 2, and therefore, prevents undesirable short-circuit due to water drops.

As the second connector 6 is inserted into the first connector 3, the tab 2*a* of each terminal plug 2 of the first connector 3 is inserted into the inner space of the associated seal 9 of the second connector 6. The tab 2*a* is further inserted into the terminal jack 5 via the opening 12 of the second chamber 4. When the second connector 6 is completely fit into the first connector 3, the tab 2*a* of the terminal plug 2 is held between the elastic contact 13 and the elastic receiver 14 of the terminal jack 5, as shown in FIG. 3. At this point of time, electric connection between the terminal plug 2 and the terminal jack 5 is achieved.

In the connected state, the first sealing projection 9*a* is in tight contact with the bottom 1*a* of the first chamber 1, as shown in FIG. 3. The first projection 9*a* seals up the first chamber 1, and prevents leakage between two adjacent terminals, as well as preventing water drops from entering the first chamber 1. Because each of the second chambers 4 have a guide 8 and a seal 9 attached to the inner wall of the guide 8, the first chambers 1 of the first connector 3 are sealed up independently in a reliable manner.

Furthermore, the second sealing projections 9*b* of the seal 9 are also in tight contact with the terminal plug 2. The second sealing projections 9*b* prevent water drops from getting into the second chamber 4.

The sealing structure of the present invention allows two connectors (a male connector and a female connector) to be coupled and sealed up, while preventing leakage between adjacent terminals and shutting out water drops from entering the chambers.

<Modification>

Figure 5:
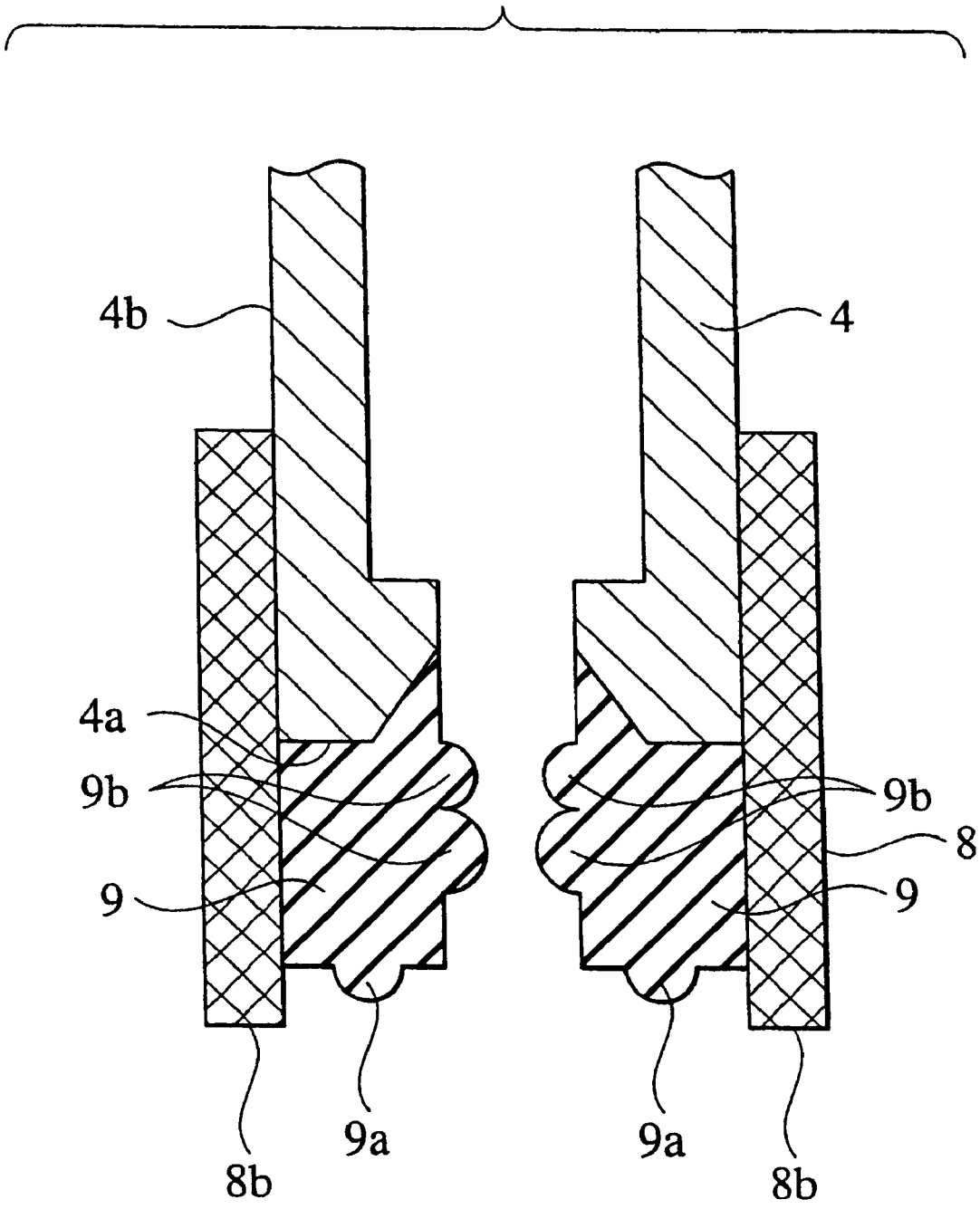
FIG. 5 illustrates a modification of the connector sealing structure, which has an alternative arrangement of the guide and the sealing member of the second connector.

FIG. 5 illustrates a modification of the sealing structure of the invention. In the above-described embodiment, the guide 8 is formed monolithically with the second chamber 4, so that the guide 8 extends from the bottom end 4*a* of the second chamber 4. As a modification, the seal 9 may be formed integrally with the second chamber 4, as shown in FIG. 5. In this case, the seal 9, which has a first sealing projection 9*a* and second sealing projections 9*b*, extends from the bottom end 4*a* of the second chamber 4. The guide 8 is fixed to the outer wall of the second chamber 4. This arrangement can achieve the object of the invention because the first and second sealing projections can prevent leakage between adjacent terminals and undesirable, and shut up water drops in an equally reliable manner.

As has been described above, the second chamber for accommodating a terminal jack (or a female terminal) has a guide and a seal attached to the inner face of the guide. The guide is received by the groove of the counterpart chamber (i.e., the first chamber) that accommodates a terminal plug (or a male terminal). The first sealing projection of the seal comes into tight contact with the bottom of the counterpart chamber, thereby up sealing the gap between the first and second chambers. The first sealing projection prevents leakage between adjacent terminals, while shutting out water drops from getting into the chambers.

The second sealing projections of the seal come into tight contact with the terminal plug. The second sealing projections can seal up the second chamber, via the terminal plug (male terminal), effectively.

The first sealing projection and the second sealing projections function as double blocks for preventing undesirable water drops from entering the terminal chambers. By using a seal made of an elastic insulator, both the water shutout ability and leakage prevention ability are further improved.

The groove formed at the bottom of the first chamber increases the total distance from the top end of the guide to the terminal plug in the first chamber. The increased amount of distance hinders water drops flowing along the outer wall of the guide from reaching the root of the terminal plug. Consequently, leakage or short circuit is prevented.

Although the invention has been described based on the preferred embodiment, the invention is not limited to the example, and many changes and substitutions are possible without departing from the scope of the invention.

What is claimed is:

1. A connector sealing structure comprising:

a first connector having one or more first terminals, each terminal being accommodated in an associated first chamber, the first chamber having a groove on its bottom and around the associated first terminal; and a second connector having one or more second terminals, each terminal being accommodated in an associated second chamber, the second chamber having a guide and a sealing member, the sealing member being fixedly attached to an inner wall of the guide and an end tip of the second chamber, wherein when the second connector is connected to the first connector, the guide of the second chamber is fit into the groove of the first chamber, and the sealing member comes into tight contact with the bottom of the first chamber and the first terminal.

2. The connector sealing structure of claim 1, wherein the sealing member is made of an elastic insulator.

3. The connector sealing structure of claim 1, wherein the guide is attached to the end tip of the second chamber.

4. The connector sealing structure of claim 1, wherein the guide is attached to an outer wall of the second chamber.

5. The connector sealing structure of claim 1, wherein the guide is formed monolithically with the second chamber.

6. The connector sealing structure of claim 5, wherein the sealing member is made of an elastic insulator.

7. The connector sealing structure of claim 1, wherein the sealing member is formed monolithically with the second chamber.

8. The connector sealing structure of claim 7, wherein the sealing member is made of an elastic insulator.

9. A connector sealing structure comprising:

a first connector having one or more first terminals, each terminal being accommodated in an associated first chamber, the first chamber having a groove on its bottom and around the associated first terminal; and a second connector having one or more second terminals, each terminal being accommodated in an associated second chamber, the second chamber having a guide and a sealing member fixedly attached to an inner wall of the guide, the sealing member having one or more first sealing projections and one or more second sealing projections, wherein the guide of the second chamber is fit into the groove of the first chamber when the second connector is connected to the first connector, and the first and second sealing projections respectively come into tight contact with the bottom face of the first chamber and the first terminal when the guide is fit into the groove.

10. The connector sealing structure of claim 9, wherein the sealing member is made of an elastic insulator.

11. The connector sealing structure of claim 9, wherein the sealing member is formed monolithically with the second chamber.

12. The connector sealing structure of claim 9, wherein the guide is inserted into the groove ahead of the first sealing projection of the sealing member reaching the bottom of the first chamber.

13. The connector sealing structure of claim 12, wherein the sealing member is made of an elastic insulator.

14. The connector sealing structure of claim 9, wherein the guide is formed monolithically with the second chamber.

15. The connector sealing structure of claim 14, wherein the sealing member is made of an elastic insulator.

16. The connector sealing structure of claim 12, wherein the guide is formed monolithically with the second chamber.

17. The connector sealing structure of claim 16, wherein the sealing member is made of an elastic insulator.

18. The connector sealing structure of claim 9, wherein the one or more first sealing projections project from a leading end of the sealing member and the one or more second sealing projections project from an inner face of the sealing member.

19. The connector sealing structure of claim 11, wherein the sealing member is made of an elastic insulator.

20. The connector sealing structure of claim 12, wherein the sealing member is formed monolithically with the second chamber.

21. The connector sealing structure of claim 20, wherein the sealing member is made of an elastic insulator.

* * * * *